US007390219B2

(12) United States Patent
Pan

(10) Patent No.: US 7,390,219 B2
(45) Date of Patent: Jun. 24, 2008

(54) ELECTRICAL CONNECTOR HAVING IMPROVED OUTER SHIELD

(75) Inventor: Feng Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/879,394

(22) Filed: Jul. 16, 2007

(65) Prior Publication Data

US 2008/0014798 A1 Jan. 17, 2008

(51) Int. Cl.
*H01R 13/648* (2006.01)

(52) U.S. Cl. ..... 439/608; 439/701

(58) Field of Classification Search ..... 439/108, 439/607, 608, 609, 701
See application file for complete search history.

(56) References Cited

U.S. PATENT DOCUMENTS 5,433,618 A 7/1995 Morlion et al.
6,299,484 B2 * 10/2001 Van Woensel ..... 439/608
6,354,877 B1 3/2002 Shuey et al.
6,461,202 B2 * 10/2002 Kline ..... 439/701
6,520,803 B1 * 2/2003 Dunn ..... 439/608
6,790,088 B2 * 9/2004 Ono et al. ..... 439/607
2002/0102885 A1 * 8/2002 Kline ..... 439/701
2008/0014798 A1 * 1/2008 Pan ..... 439/607
2008/0020642 A1 * 1/2008 Pan ..... 439/607

* cited by examiner

*Primary Examiner*—James Harvey
(74) *Attorney, Agent, or Firm*—Wei Te Chung

(57) ABSTRACT

An electrical connector (100) for being mounted on a printed circuit board includes an insulative housing (10) defining a number of terminal slots (141, 151), a number of terminal modules (20), a number of inner shielding plates (30) each disposed between two adjacent terminal modules and an outer shield (40) attached to the insulative housing. The outer shield has a top wall (41), a rear wall (42) extending downwardly from the top wall and a bending portion (43) extending inwardly downwardly from end of the rear wall for engaging with the inner shielding plates.

12 Claims, 6 Drawing Sheets

ELECTRICAL CONNECTOR HAVING IMPROVED OUTER SHIELD

BACKGROUND OF THE INVENTION

1. Field of the Invention

The present invention relates to an electrical connector, and more particularly to a backplane connector having an improved conductive outer shield for engaging with inner shielding plates.

2. Description of the Prior Art

In the manufacture of computers and various other electronic assemblies, daughter boards are commonly connected to mother boards by an electrical connector such as backplane connector. U.S. Pat. No. 6,354,877, issued on Mar. 12, 2002, discloses a backplane connector having an external shield and a plurality of inner shielding plates for reducing crosstalk. A plurality of horizontal eyelets are disposed on an inner surface of the external shield. Each inner shielding plate has a transverse section, a pair of notches located on the transverse section, and a pair of vertical latches extending into the notches and inserting into the horizontal eyelets of the external shield. In this manner, the inner shielding plates are fixed onto the external shield. It would be complicated to assemble the inner shielding plates to the external shield.

U.S. Pat. No. 5,433,618, issued on Jul. 18, 1995, discloses a backplane connector having an external shield defining a plurality of longitudinal slots. The backplane connector also comprises a plurality of inner shielding plates each provided with an extension coupling with the longitudinal slot and projecting beyond a rear surface of the external shield. It is difficult to withstand electrical interference for the inner shielding plates. Additionally, the engagement between the inner shielding plate and the external shield is not reliable, since the extensions project beyond the external shield to have a collision easily.

Hence, an improved electrical connector is needed to solve the above problem.

BRIEF SUMMARY OF THE INVENTION

One object of the present invention is to provide an electrical connector comprising an improved conductive outer shield having a bending portion for more simply and reliably engaging with an inner shielding plate.

The present invention provides an electrical connector comprising an outer shield and a plurality of inner shielding plates mounted to the outer shield. The outer shield has a top wall extending horizontally, a rear wall extending downwardly from the top wall and a bending portion bending inwardly downwardly from an end portion of the rear wall for engaging with the inner shielding plate. The inner shielding plate comprises an extension extending rearwardly therefrom. A plurality of parallel grooves are defined on the bending portion for engaging with the extensions. The bending portion comprises a body section and a medial section connecting the body section to an end of the rear wall, a receiving space being formed outside an outer surface of the body section and below a lower surface of the medial section for receiving the extension of the inner shielding plate.

Advantages of the present invention are to provide an outer shield having bending portion defining a plurality of grooves coupled with the inner shielding plates for simplifying the process of assembling the inner shielding plates to the outer shield. Additionally, the outer shield has a receiving space being formed outside an outer surface of the body section and below a lower surface of the medial section for receiving the extension of the inner shielding plate. The extension would not project beyond the rear wall for avoiding being collided. Therefore, the electrical connector may withstand electrical interference more effectively and enhance the engagement between the outer shield and the inner shielding plates.

Other objects, advantages and novel features of the invention will become more apparent from the following detailed description of the present embodiments when taken in conjunction with the accompanying drawings.

DETAILED DESCRIPTION OF THE INVENTION

Figure 1:
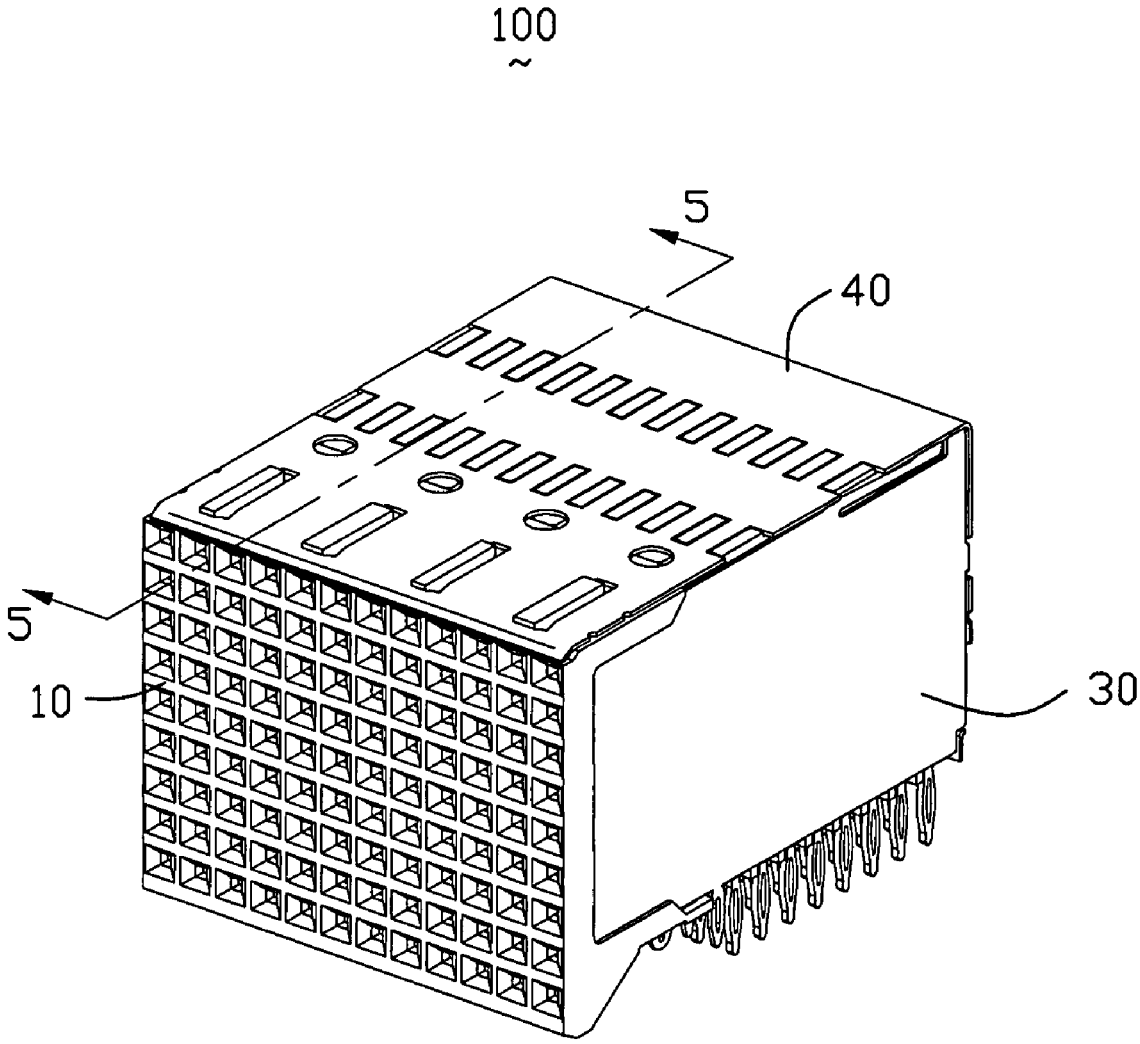
FIG. 1 is an assembled perspective view of an electrical connector.
Figure 2:
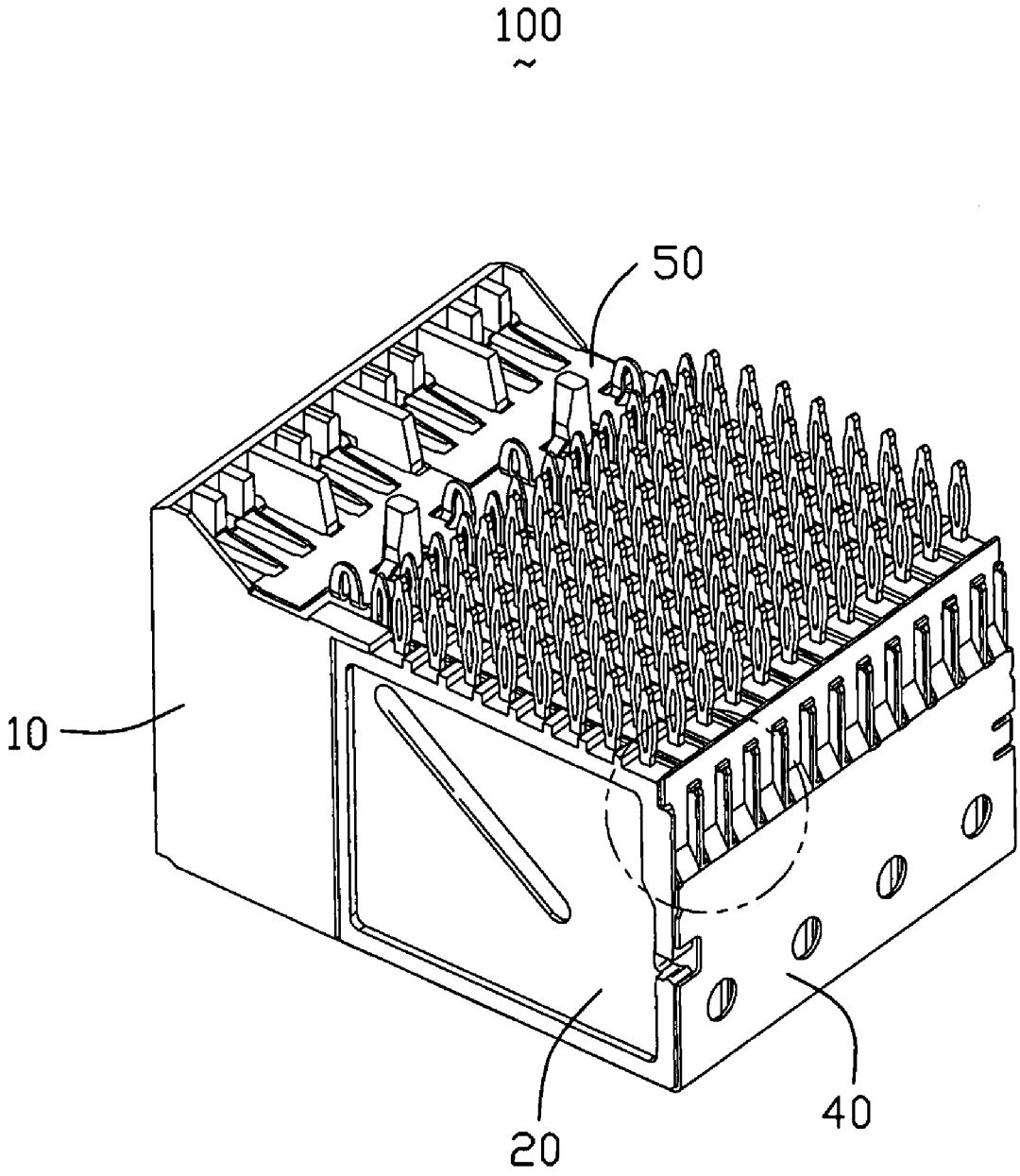
FIG. 2 is a perspective view of the electrical connector as shown in FIG. 1, taken from another aspect.

Reference will now be made to the drawing figures to describe the present invention in detail. Referring to FIGS. 1-4, an electrical connector 100 for being mounted on a printed circuit board (not shown) comprises an insulative housing 10, a plurality of terminal modules 20 each having a plurality of terminals 21 fixed therein, an outer shield 40, a plurality of inner shielding plates 30 engaging with the outer shield 40 and a pair of connection plates 50 mounted to a bottom of the insulative housing 10.

Figure 3:
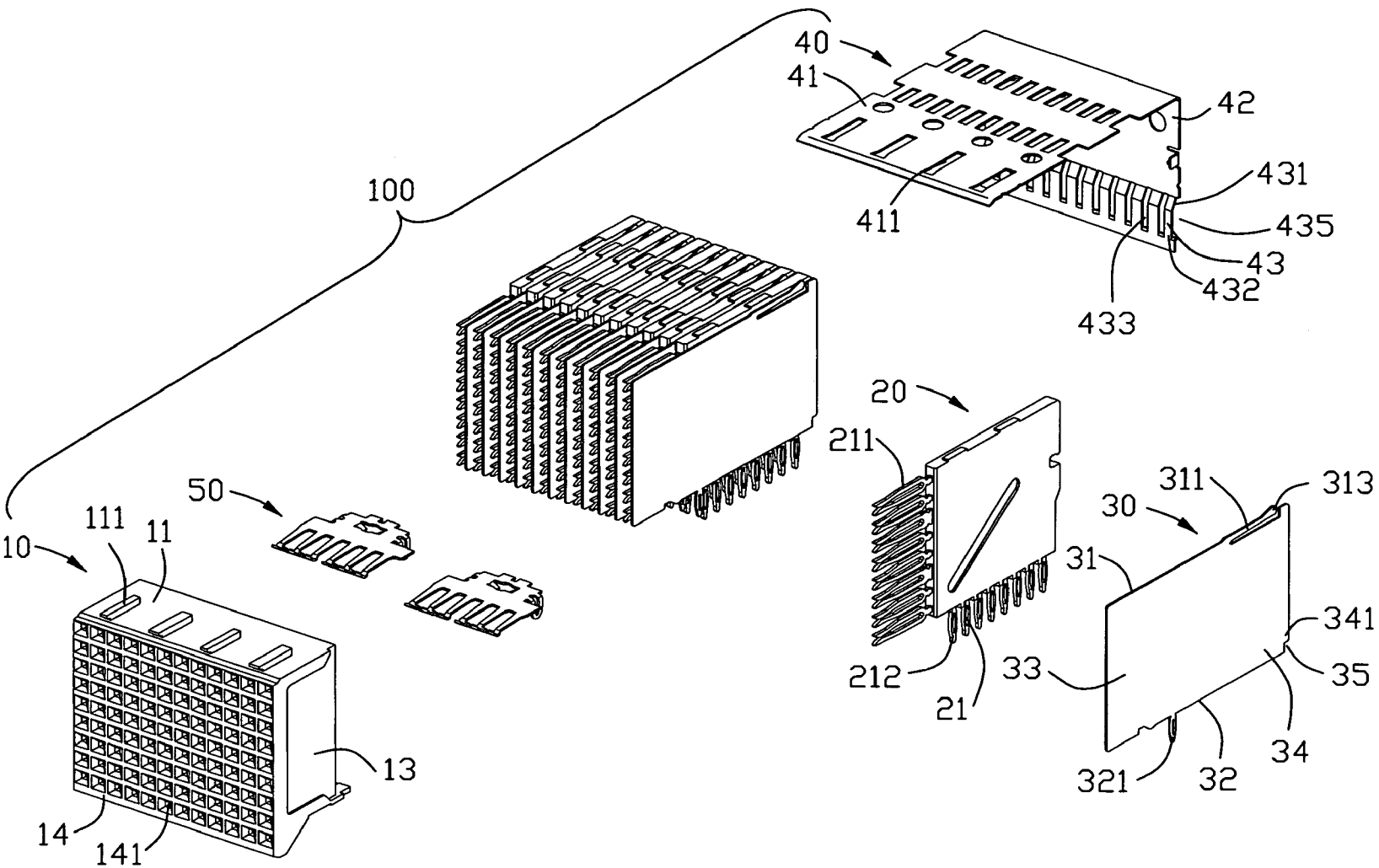
FIG. 3 is an exploded view of the electrical connector as shown in FIG. 1.
Figure 4:
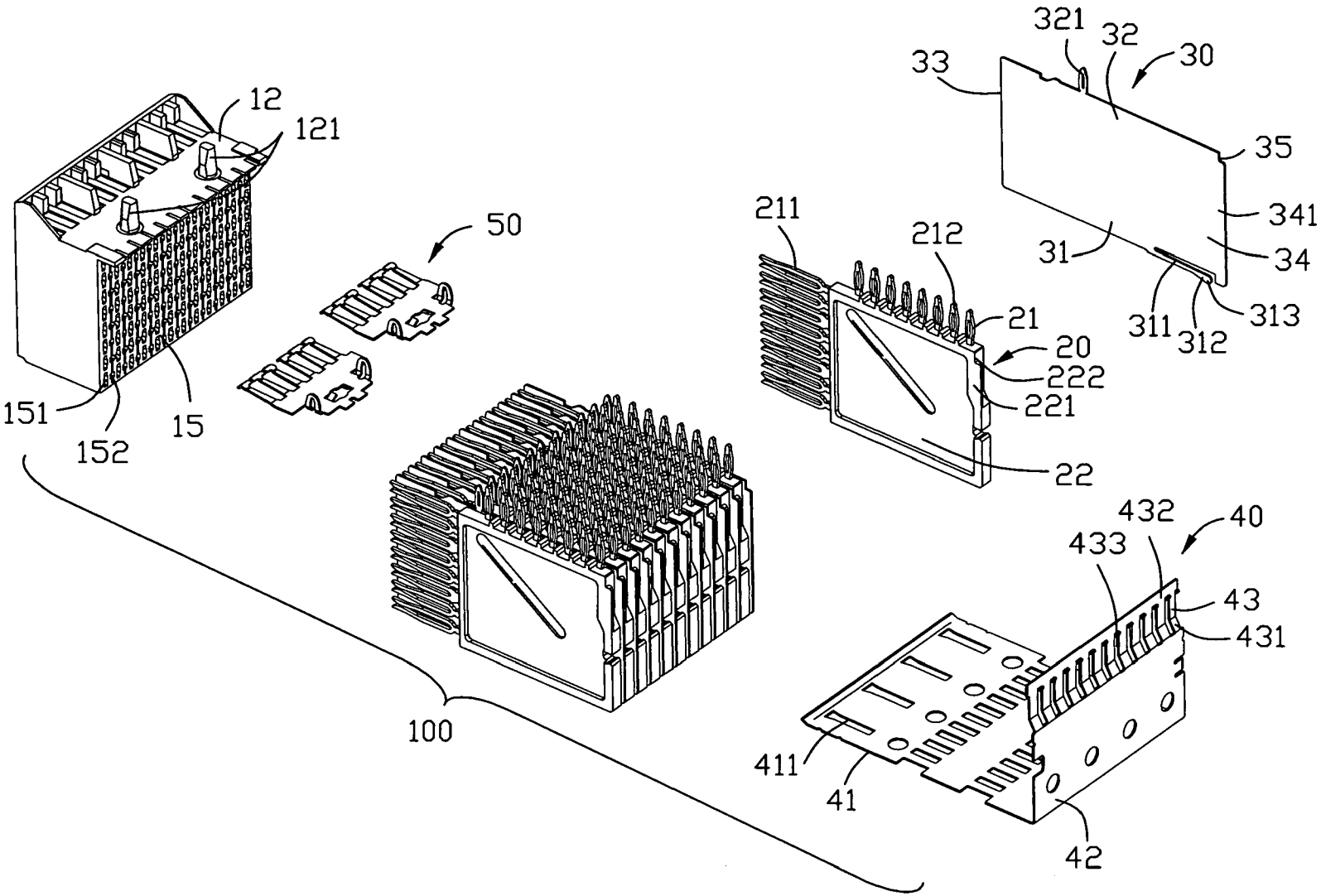
FIG. 4 is another exploded view similar to FIG. 3, taken from another aspect.

Referring to FIGS. 3 and 4, the insulative housing 10 has a top face 11, a bottom face 12, a pair of opposite side faces 13, a front face 14 and a rear face 15. The top face 11 includes a plurality of protruding blocks 111 for coupling with a plurality of corresponding holds 411 defined on the outer shield 40. A pair of pegs 121 are disposed on the bottom face 12 to properly position the insulative housing 10 on the print circuit board. The front face 14 is provided with a plurality of first terminal slots 141 extending rearwardly therefrom for engaging with a mating plug (not shown). The rear face 15 defines a plurality of second terminal slots 151 extending forwardly therefrom for communicating with the first terminal slots 141. The insulative housing 10 further defines a plurality of receiving passages 152 each located adjacent to each second terminal slot 151 for receiving the inner shielding plate 30. The second terminal slots 151 are arranged in a plurality of columns, and the inner shielding plates 30 resides between adjacent ones of said plurality of columns.

The outer shield 40 has a top wall 41 extending horizontally, a rear wall 42 extending downwardly from the top wall 41 and a bending portion 43 bending inwardly downwardly from end of the rear wall 42 for engaging with the inner shielding plates 30. A plurality of parallel grooves 433 are defined on the bending portion 43 for engaging with the inner shielding plates 30. The bending portion 43 comprises a body section 432 and a medial section 431 extending obliquely and connecting the body section 432 to the end of rear wall 42, therefore forming a receiving space 435 between an outer surface of body section 432 and a lower surface of the medial section 431.

The inner shielding plate 30 is of a rectangular shape and has an extension 341 projecting rearwardly from a rear portion 34 thereof and a first stepped portion 35 disposed on an end edge of the extension 341. The extension 341 of the inner shielding plate 30 is received in the receiving space 435 and would not project beyond a plane of the rear wall 42. The first stepped portion 35 is of a right-angled shape for engaging with a lower end of the groove 433 of the outer shield 40. The inner shielding plate 30 further comprises a spring latch 311 disposed on a top portion 31 thereof and a protrusion 313 disposed on a free end of the spring latch 311 for resisting against the outer shield 40. A grounding contact 321 is disposed on a bottom portion 32 of the inner shielding plate 30 and connected to the printed circuit board.

Each terminal module 20 has an insulative frame 22 and a plurality of terminals 21 fixed into the insulative frame 22. The terminal 21 has a first contacting portion 211 extending outwardly horizontally from the insulative frame 22 and received in the second terminal slot 151, a second contacting pin 212 extending outwardly downwardly from the insulative frame 22 and electrically connecting with the printed circuit board. The insulative frame 22 has a bottom board 221 and defines an indention 222 for engaging with the groove 433 of the outer shielding plate 40.

Figure 5:
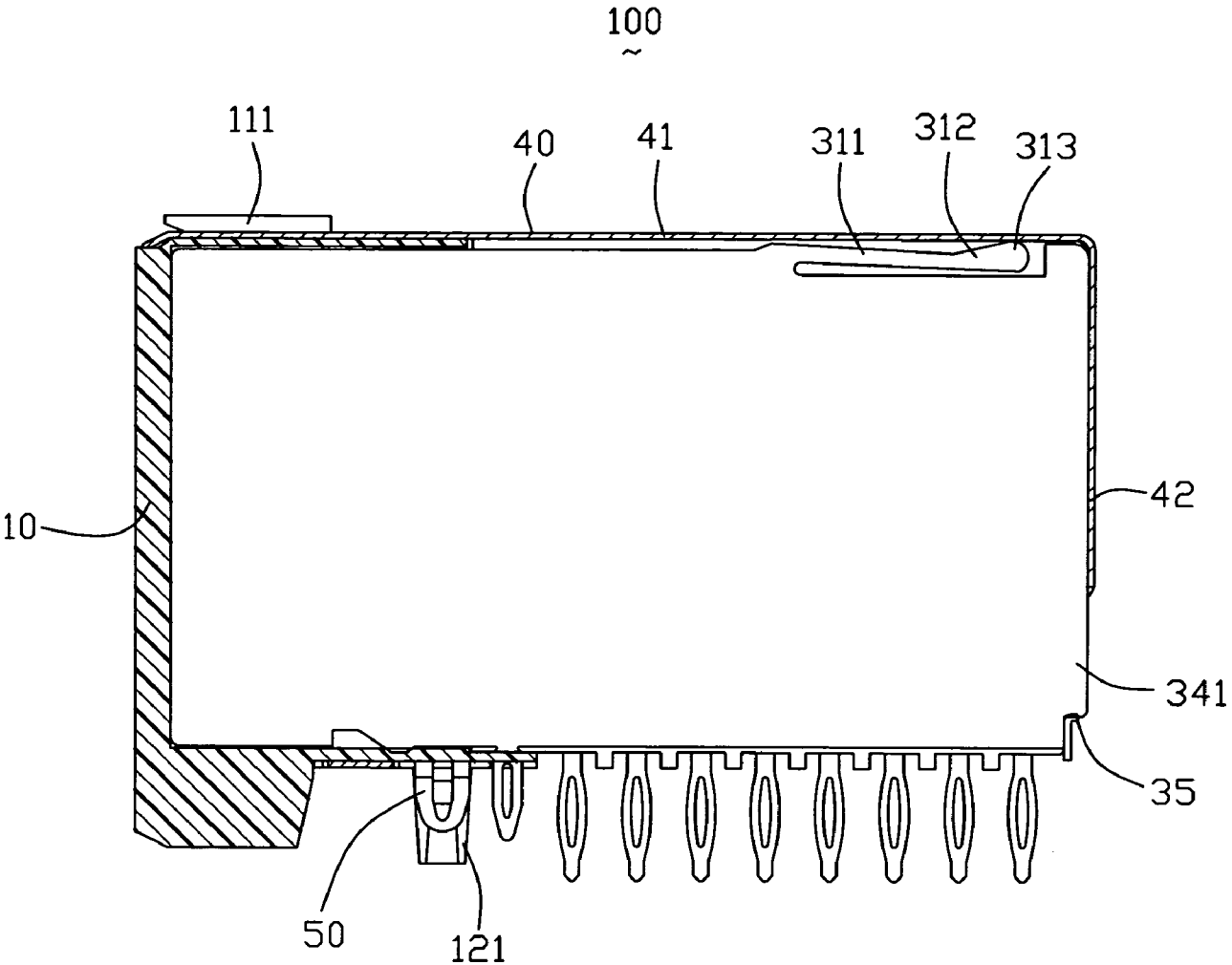
FIG. 5 is a cross-sectional view of the electrical connector taken along line 5-5 of FIG. 1.
Figure 6:
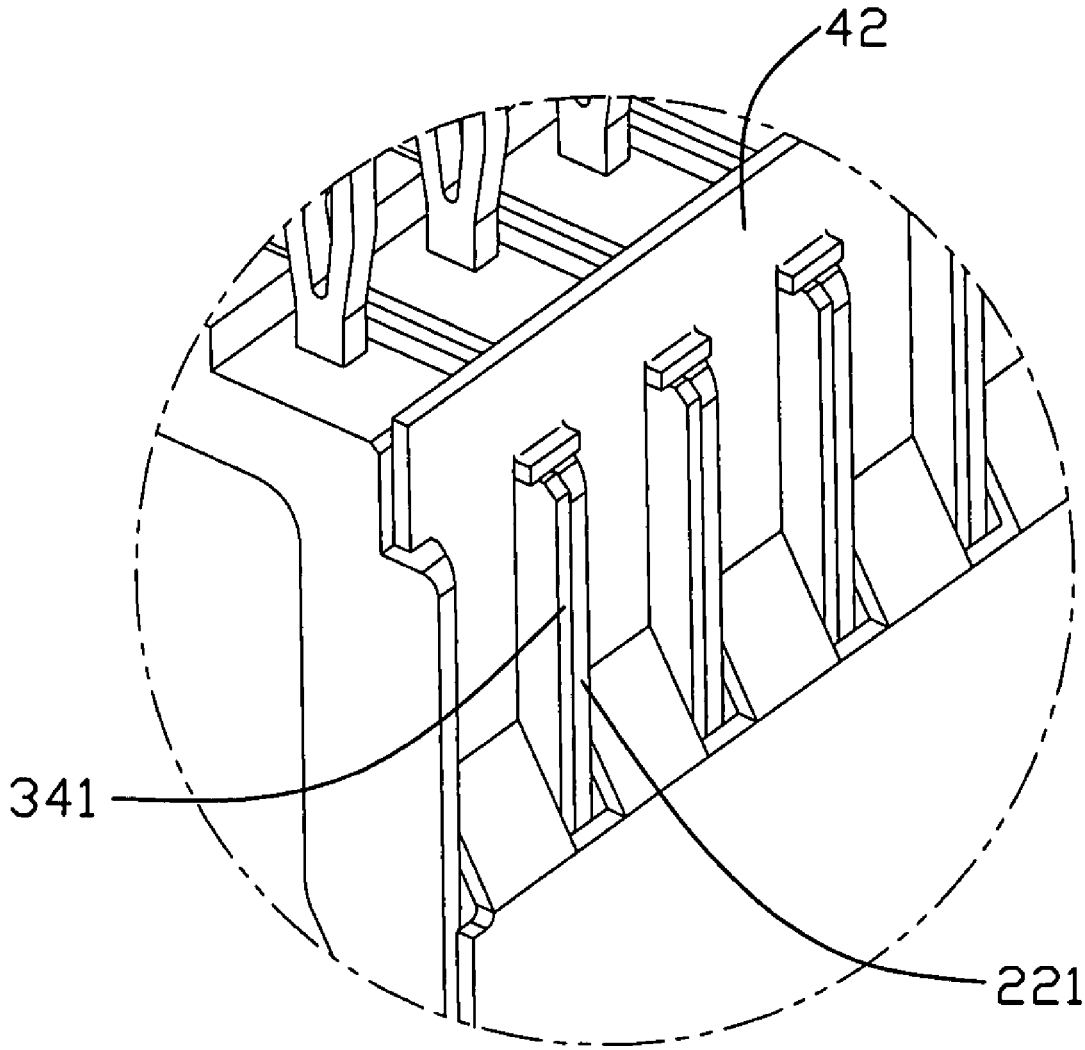
FIG. 6 is a magnifying view of the electrical connector, as especially labeled in FIG. 2.

Referring to FIGS. 5 and 6, in assembling of the electrical connector 100, firstly, the terminal modules 20 are inserted into the insulative housing 10 in a rear-to-front direction, with first contacting portions 211 received in the second terminal slots 151. The inner shielding plates 30 are received in the receiving passages 152. Each terminal module 20 and corresponding inner shielding plate 30 are located one next to the other. Secondly, the outer shield 40 is attached to a top portion and a rear portion of the insulative housing 10. The extensions 341 of the inner shielding plates 30 extend through the grooves 433 of the bending portions 43 of the outer shield 40 and are completely received within the receiving spaces 435. The first stepped portion 35 of the inner shielding plate 30 has a vertical edge resting against the body section 432. At this time, the protrusion 313 of the spring latch 311 is abutted against the top wall 41 of the outer shield 40 for firmly attaching inner shielding plates 30 to the outer shield 40. The bottom board 221 of the terminal module 20 is partially resisting against a lower end of the groove 433, and partially extending out of the groove 433. The second contacting pins 212 of the terminals 21 and the grounding contacts 321 extend downwardly and connecting to the print circuit board. Finally, the pair of connection plates 50 are mounted to the bottom of the insulative housing 10.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted on a printed circuit board, comprising:

an insulative housing defining a plurality of terminal slots;

a plurality of terminal modules each having a plurality of terminals, each terminal having a first contacting portion received in the terminal slot;

a plurality of inner shielding plates each disposed between two adjacent terminal modules; and an outer shield attached to the insulative housing and comprising a top wall, a rear wall extending downwardly from the top wall and a bending portion extending inwardly and downwardly from an end of the rear wall, said bending portion electrically connecting the inner shielding plates.

2. The electrical connector as claimed in claim 1, wherein each inner shielding plate has an extension, and wherein said bending portion of the outer shield comprises a plurality of grooves for engaging with extensions of the inner shielding plates.

3. The electrical connector as claimed in claim 2, wherein said inner shielding plate is provided with a first stepped portion at an end edge thereof for engaging with a lower end of the groove of the bending portion.

4. The electrical connector as claimed in claim 2, wherein said bending portion comprises a body section and a medial section connecting the body section to the end of the rear wall, a receiving space being formed outside an outer surface of the body section and below a lower surface of the medial section for receiving the extension of the inner shielding plate.

5. The electrical connector as claimed in claim 4, wherein said extension of the inner shielding plate is received within the receiving space inwardly of the rear wall.

6. The electrical connector as claimed in claim 5, wherein said terminal module comprises an insulative frame having a bottom board extending through the groove of the outer shield and being adjacent to the extension of the inner shielding plate.

7. The electrical connector as claimed in claim 6, wherein said terminal module comprises a second stepped portion disposed at an end edge of the bottom board for coupling with the lower end of the groove of the bending portion.

8. The electrical connector as claimed in claim 1, wherein said inner shielding plate comprises a spring latch disposed on a top thereof for resisting against the top wall of the outer shield.

9. The electrical connector as claimed in claim 1, wherein said terminal slots are arranged in a plurality of columns, and inner shielding plate resides between adjacent ones of said plurality of columns.

10. The electrical connector as claimed in claim 1, wherein said outer shield defines a plurality of holes on the top wall, and wherein said insulative housing is provided on a top portion thereof with a plurality of protruding blocks received in the holes.

11. The electrical connector as claimed in claim 1, further comprising a pair of connection plates mounted to a bottom of the insulative housing.

12. The electrical connector as claimed in claim 1, wherein said terminal has a second contacting pin extending downwardly.

* * * * *